US006789556B2

(12) United States Patent
You

(10) Patent No.: US 6,789,556 B2
(45) Date of Patent: Sep. 14, 2004

(54) UMBRELLA FRAME

(76) Inventor: Ching-Chuan You, c/o Percy International Patent Corp. P.O. Box 1-79, Taipei (TW)

( * ) Notice: Subject to any disclaimer, the term of this patent is extended or adjusted under 35 U.S.C. 154(b) by 0 days.

(21) Appl. No.: 10/352,736

(22) Filed: Jan. 29, 2003

(65) Prior Publication Data

US 2004/0144409 A1 Jul. 29, 2004

(51) Int. Cl.[7] ..... A45B 25/00
(52) U.S. Cl. ..... 135/31; 135/29; 135/32
(58) Field of Search ..... 135/31, 29, 32, 135/22, 15.1, 25.3, 25.1

(56) References Cited

U.S. PATENT DOCUMENTS 5,372,155 A * 12/1994 You ..... 135/29
5,715,853 A * 2/1998 Lin ..... 135/29
5,746,235 A * 5/1998 Lin ..... 135/29
6,076,540 A * 6/2000 You ..... 135/22
6,102,058 A * 8/2000 You ..... 135/29
6,345,637 B1 * 2/2002 Ko ..... 135/22
D484,680 S * 1/2004 You ..... D3/10
2003/0029485 A1 * 2/2003 Jophnson et al. ..... 135/29
2003/0098049 A1 * 5/2003 Huang ..... 135/29
2003/0159726 A1 * 8/2003 You ..... 135/29

* cited by examiner

*Primary Examiner*—Leslie A. Braun
*Assistant Examiner*—Amy J. Sterling

(57) ABSTRACT

A folded umbrella frame has a plurality of units each comprising a second pivot mechanism, a first pivot mechanism fixed to the lower rib, a first pivot connecting member pivotably coupling to the first pivot mechanism, a second pivot connecting member receiving the upper rib and pivotably coupling to the second pivot mechanism and a steel rod hooking the second pivot connecting member and the first pivot mechanism together. The spreader passes through the channels of the second pivot mechanism to receive in the first bore of the first pivot connecting member. The invention effects a smooth folding by employing no rivet and a reduced size after folded.

11 Claims, 8 Drawing Sheets

UMBRELLA FRAME

BACKGROUND OF THE INVENTION

1. Field of the Invention

The present invention relates to umbrellas and more particularly to an FRP (fiber glass reinforced plastics) umbrella frame with characteristics such as enhanced strength, quick assembly, and reduced size after folded.

2. Description of Related Art

Umbrella frame designs take many different forms. A conventional umbrella having a two-section rib is shown in FIG. 9. Such umbrella frame has a number of disadvantages as observed by the present inventor. For example, a rivet is used in each of five pivot joints P1 to P5. However, it is known that riveting is a tedious task. Also, uniform quality of riveting on the pivot joints P1 to P5 for each frame element is not easy to control. Typically, there are about total 30 to 40 pivot mechanisms in an umbrella frame. Unfortunately, one defective pivot mechanism will make the whole umbrella unusable after a short period of time due to rust in the pivot mechanisms. Further, stress tends to concentrate on the pivot mechanisms. As a result, the frame is susceptible of break in folding or expanding the umbrella.

An FRP umbrella for solving the problem of rust in the pivot mechanisms caused by riveting is proposed. However, the FRP umbrella still suffered from several disadvantages. For example, ribs of the FRP umbrella frame are shaped as cylinders for providing a sufficient support to the frame. Also, a variety of plastic molded connecting elements and pivot elements are fitted at two ends and in intermediate section of the cylindrical rib, respectively. As such, each frame element is increased in size, resulting in a bulky FRP frame. This can cause difficulties in storage, packing, and delivery of the umbrella. Hence, a commercialized FRP umbrella is still not available after such technique has been developed for more than 20 years. Thus, continuing improvements in the FRP umbrella frame are constantly being sought.

SUMMARY OF THE INVENTION

It is an object of the present invention to provide an FRP umbrella frame having advantages such as enhanced strength, quick assembly, and much reduced size after folded.

It is another object of the present invention to provide a lightweight FRP umbrella frame for facilitating storage, packing, and delivery.

It is a further object of the present invention to provide an enhanced FRP umbrella frame for prolonging a useful life.

The above and other objects, features and advantages of the present invention will become apparent from the following detailed description taken with the accompanying drawings.

DETAILED DESCRIPTION OF THE PREFERRED EMBODIMENTS

Figure 1:
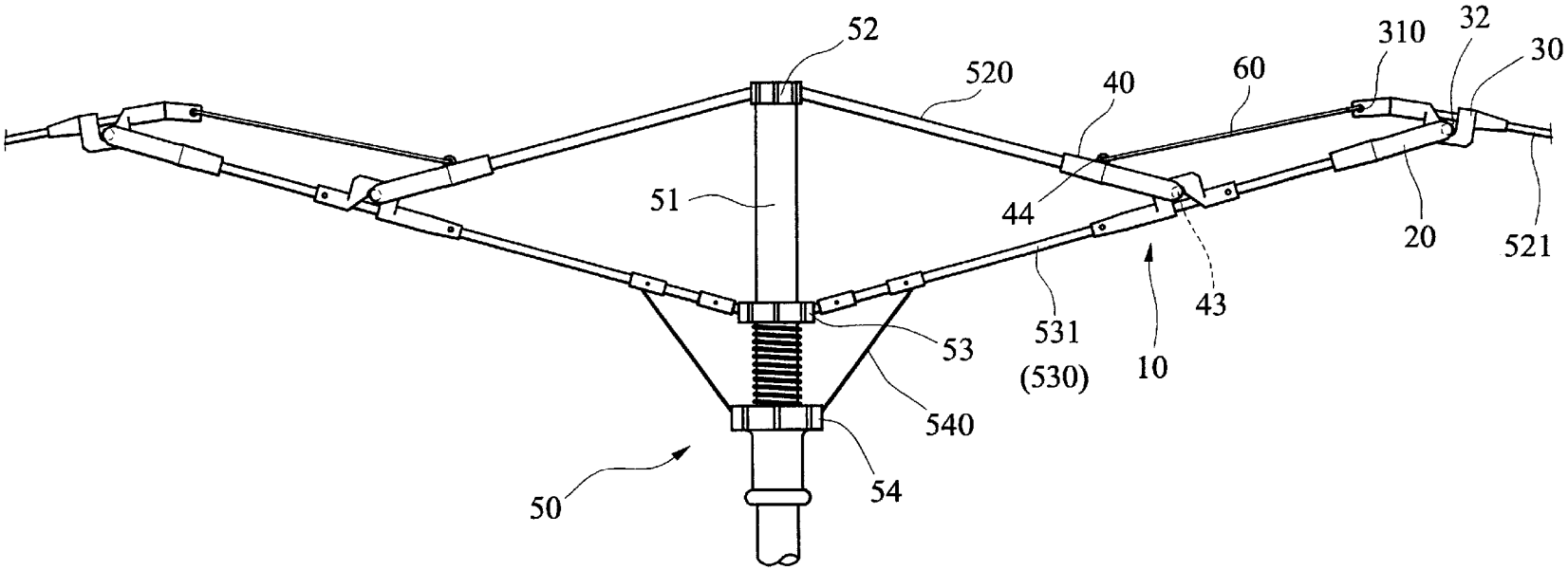
FIG. 1 is a side elevational view of frame of a FRP umbrella according to a first preferred embodiment of the invention.

Referring to FIGS. 1 to 4, there is shown an FRP umbrella frame 50 according to a first preferred embodiment of the invention. Note that components such as a hub 52 on a top of a shank 51, a plurality of ribs 520 radially extended outwardly from the hub 52, upper and lower rings 53, 54 both slidably sleeved on the shank 51, a spring (not numbered as part of automatic umbrella) biased between the upper and lower rings 53, 54, a plurality of corresponding spreaders 530, 531 joined between the ribs 520 and the upper ring 53, and a plurality of corresponding auxiliary stretchers (as part of automatic umbrella) 540 joined between the spreaders 530, 531 and the lower ring 54 will not be described in detail below because they are well known except the spreaders 530, 531 and portions connecting the ribs 520, 521 and the spreaders 530, 531 critical to the invention.

As shown, in an inner rib connection portion there is provided a second pivot mechanism 10 at about middle sections of the spreaders 530, 531. The second pivot mechanism 10 includes an elongate connector 11 having two parallel first and second channels 110, 111, an inverted U-shaped attachment member 12 having one end coupled to the connector 11, and an extension sleeve 13 coupled to the other end of the attachment member 12, the extension sleeve 13 including a third channel 130 is aligned with the first channel 110. A slope 121 is extended from an underside tunnel 120 of the attachment member 12 to one end of the extension sleeve 13 for facilitating a cylindrical cross bar 43 of a second pivot connecting member 40 to move into the tunnel 120. One spreader 530 passes through the first channel 110 and the third channel 130 while the other spreader 531 passes through the second channel 111.

In an outer rib connection portion, there are provided the following elements. A first pivot connecting member 20 includes first and second bores 21, 22 for receiving outer ends of the spreaders 530, 531 respectively, a rectangular opening 23 at the other end opposite to the first and second bores 21, 22, and a cylindrical cross bar 24 at an outer side of the opening 23, the cross bar 24 being pivotably coupled to a first pivot mechanism 30. A width of the first pivot mechanism 30 is slightly smaller than that of the opening 23 of the first pivot connecting member 20 so that one end of the first pivot mechanism 30 can pass the opening 23 in assembly. At one end of the first pivot mechanism 30 toward the first pivot connecting member 20 there are formed a connector 31 and a through hole 310 at an open end of the connector 31. A fixing hole 311 is provided at one end of the first pivot mechanism 30 and the other end of the first pivot mechanism 30 also provided with a channel 312 for passing the lower rib 521 therethrough. A U-shaped tunnel 32 is formed on a central portion of the first pivot mechanism 30. A slope 33 is formed at a side of the tunnel 32 coupled to the connector 31 for facilitating the cross bar 24 of the first pivot connecting member 20 to move into for engagement.

The second pivot connecting member 40 has a bore 41 at one end for receiving and fixing the outer end of the upper rib 520 and a rectangular opening 42 at the other end, the opening 42 having a width slightly larger than that of the attachment member 12 of the second pivot mechanism 10. Hence, the opening 42 can pass the extension sleeve 13 and the slope 121 to position in the tunnel 120 of the attachment member 12. The cylindrical cross bar 43 is formed at an outer side of the opening 42. A recess 45 is formed beside the opening 42, and a third opening 44A is formed within the recess 45 extending through the second pivot connecting member 40. A U-shaped hook member 44 is nested in a third opening 44A. A rod 60 has one hook end 61 hooked with the hook member 44 and the other hook end 62 inserted through the hole 310 for fastening the second pivot connecting member 40 and the first pivot mechanism 30 together.

In assembly, insert the upper rib 520 into the bore 41 of the second pivot connecting member 40 for fastening. Next, pass the cross bar 43 through the slope 121 to anchor in the tunnel 120 of the attachment member 12 for pivotably coupling the opening 42 of the second pivot connecting member 40 to the attachment member 12 of the second pivot mechanism 10. Then insert the spreader 530 through the first channel 110 and the third channel 130 into the first bore 21 and insert the spreader 531 through the second channel 111 into the second bore 22 respectively for parallel fastening. As such, the cross bar 43 of the second pivot connecting member 40 will be closed within the tunnel 120 and can pivot about the tunnel 120 of the second pivot mechanism 10. Next, pass the opening 23 of the first pivot connecting member 20 through the connector 31 and the slope 33 to anchor in the tunnel 32 of the first pivot mechanism 30 and then insert the lower rib 521 from the channel 312 into the fixing hole 311 of the first pivot mechanism 30. As such, the cross bar 24 will be closed within the tunnel 32 and permitting the cross bar 24 to pivot about the tunnel 32. Finally, hook the hook end 61 of the rod 60 through the hook member 44 and the other hook end 62 thereof through the hole 310 for fastening the second pivot connecting member 40 and the first pivot mechanism 30 together. As an end, a complete frame is formed.

Figure 2:
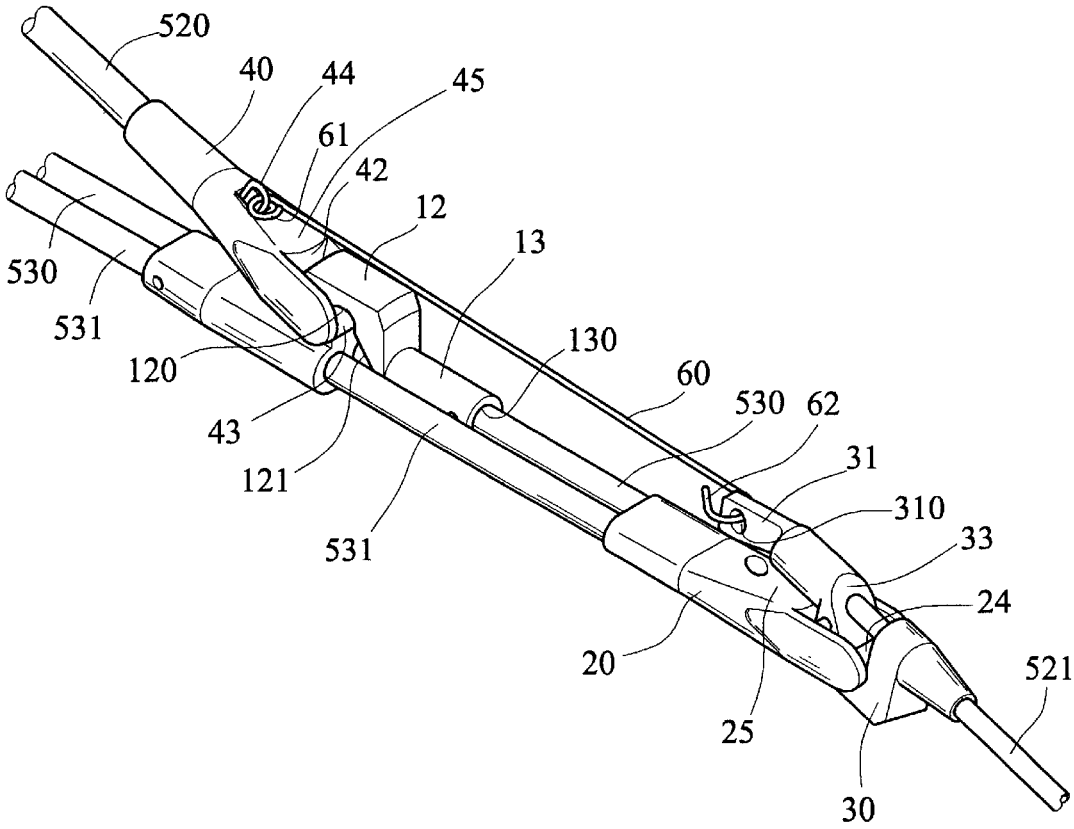
FIG. 2 is a perspective view of an frame element of FIG. 1.
Figure 3:
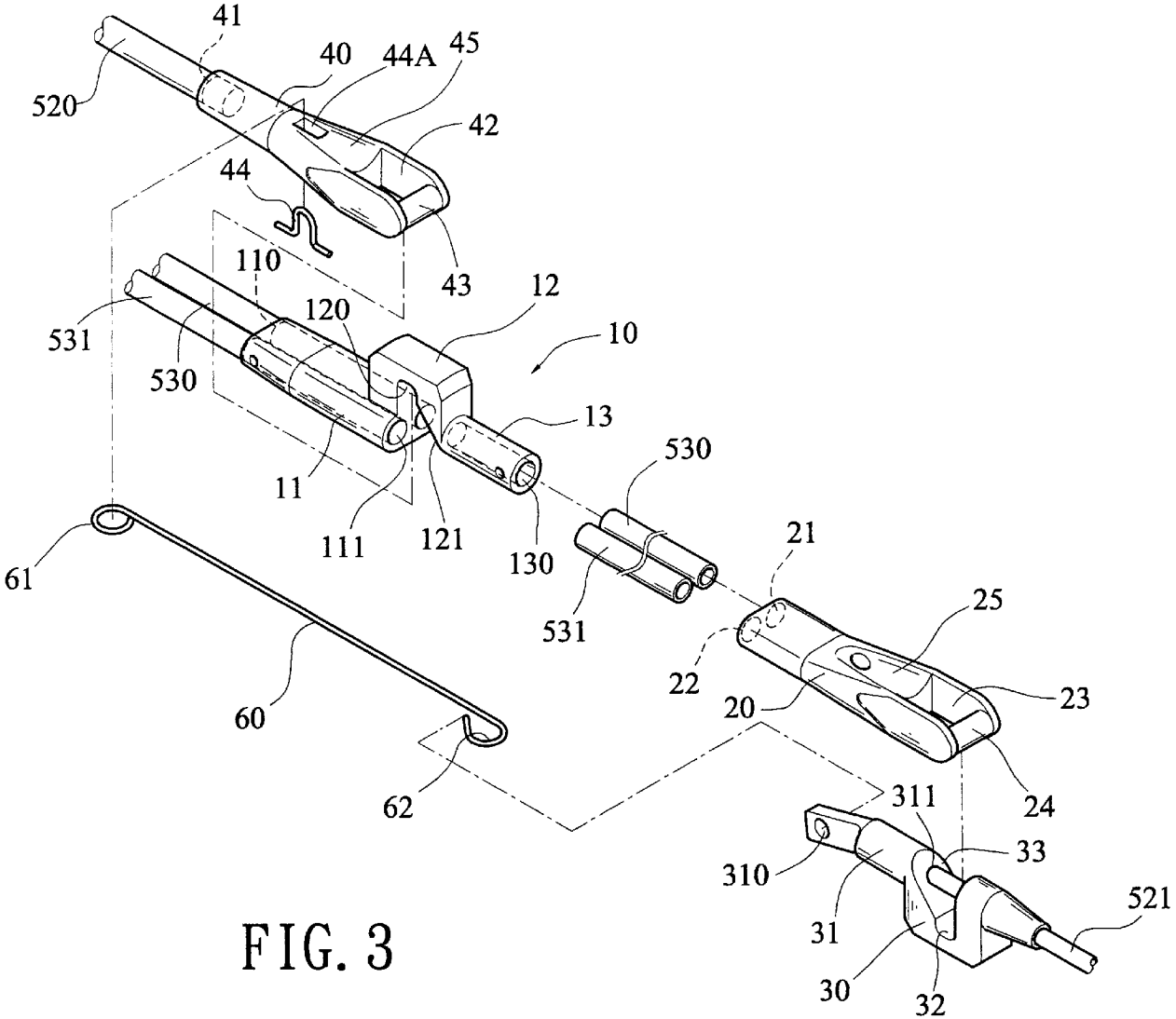
FIG. 3 is an exploded perspective view of FIG. 2.
Figure 4:
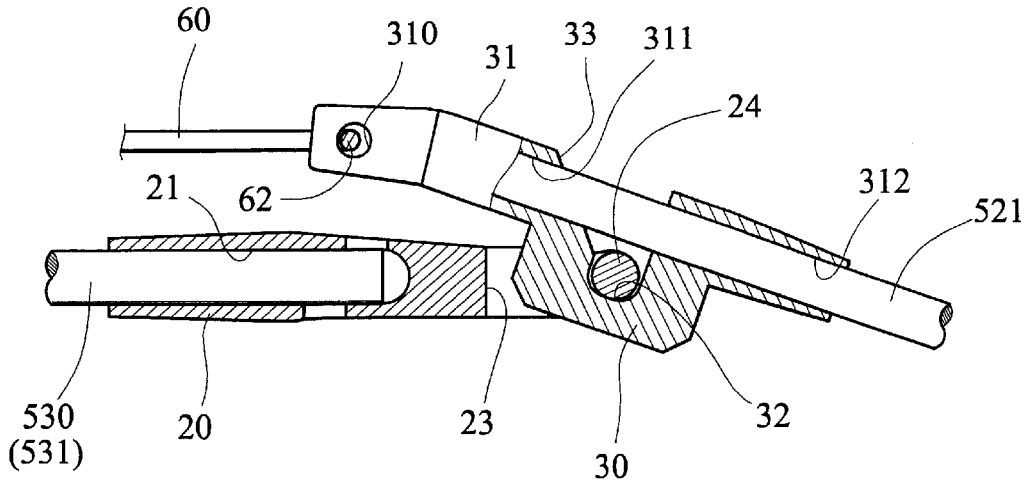
FIG. 4 is a side elevational view in part section of an outer rib connection portion of FIG. 1.

In order to reduce the size of folded umbrella frame, in addition to lower the width of the pivot connecting member and the pivot mechanism, there are provided a both side recesses 25, 45 at the main surface of the first and second pivot connecting members 20 and 40, respectively (as shown in FIGS. 2 and 3).

Figure 5:
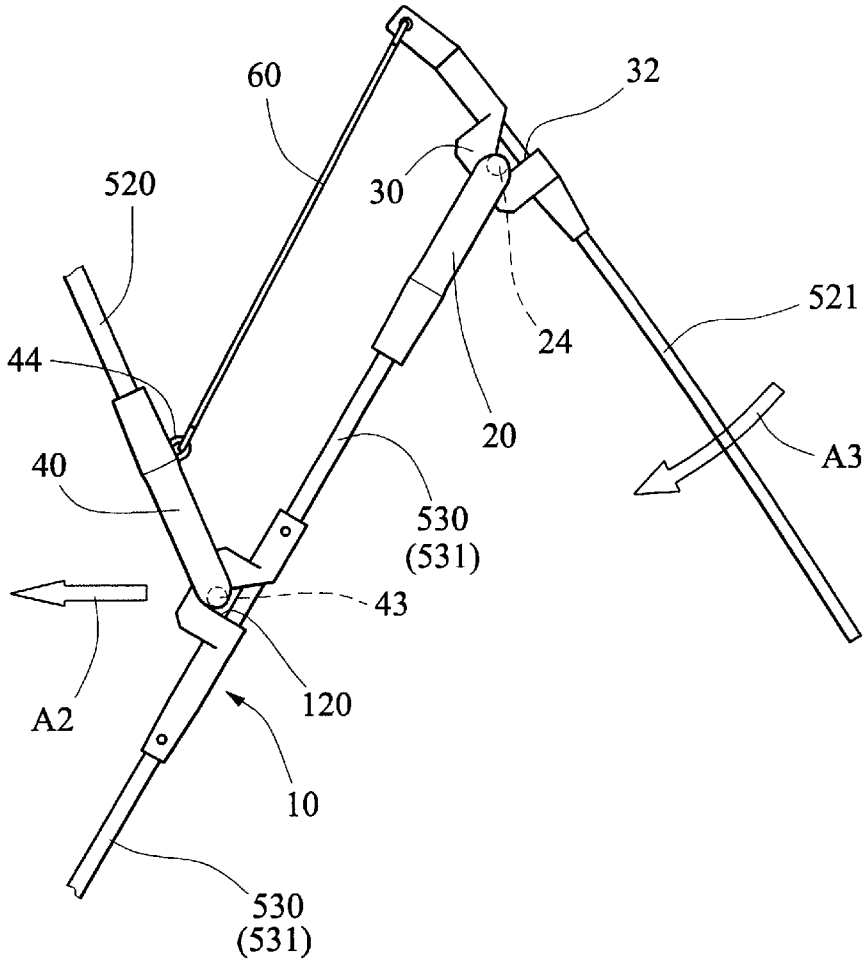
FIG. 5 is a side elevational view showing the frame being folded.
Figure 6:
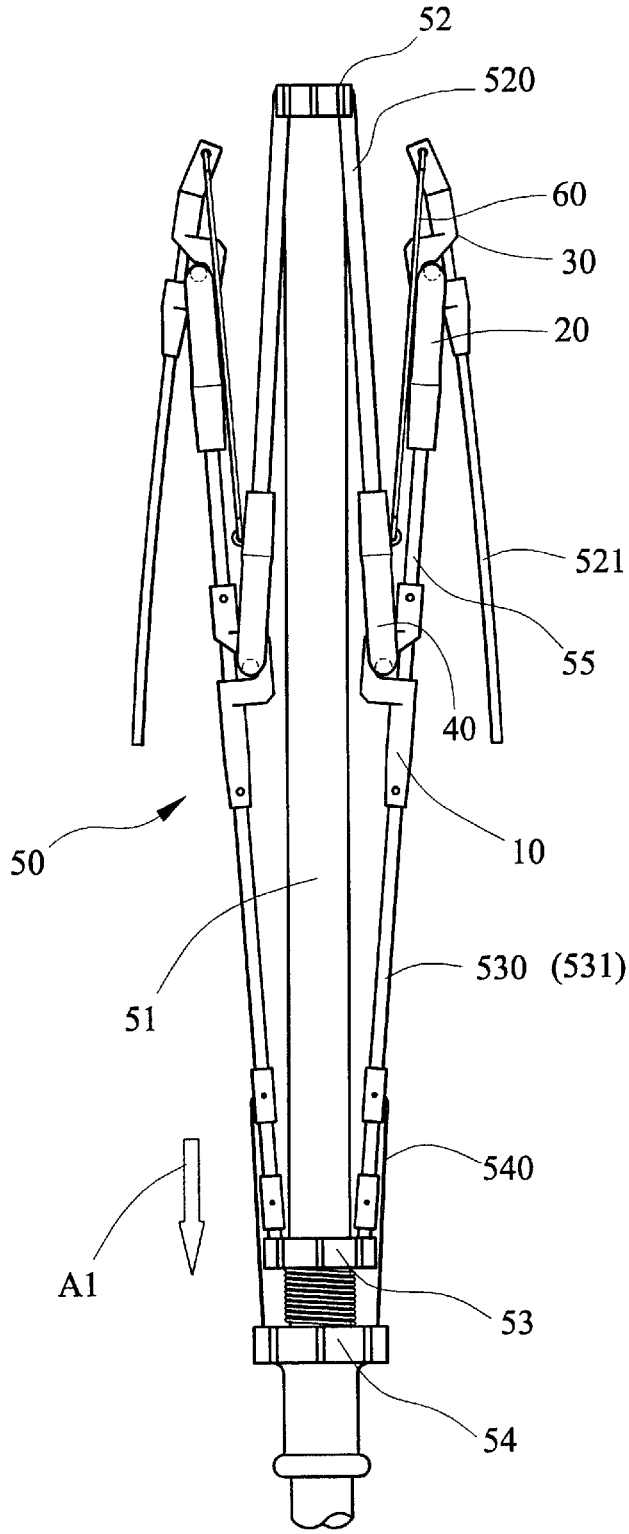
FIG. 6 is a side elevational view showing the frame in a folded position.

Referring to FIGS. 5 and 6, a folding operation of the expanded frame 50 will now be described in detail below. First, slide down the upper and lower rings 53, 54 along the shaft 51 as indicated by arrow A1. At the same time, the spreaders 530, 531 move downward to cause the second pivot mechanism 10 to move inward and downward as indicated by arrow A2. The second pivot connecting member 40 then pivot about the second pivot mechanism 10 to form a larger angle therebetween. Next, the rods 60 moved by the second pivot connecting member 40 further cause the first pivot mechanism 30 to pivot. Also, the lower ribs 521 extended outward from the first pivot mechanism 30 fold toward the spreaders 530, 531 as indicated by arrow A3. Finally, a folded frame 50 with the spreaders 530, 531 and the ribs 520, 521 in close proximity to the shaft 51 is formed, as shown in FIG. 6. In view of the above, the invention can effect a quick, smooth folding or expanding operation.

Figure 7:
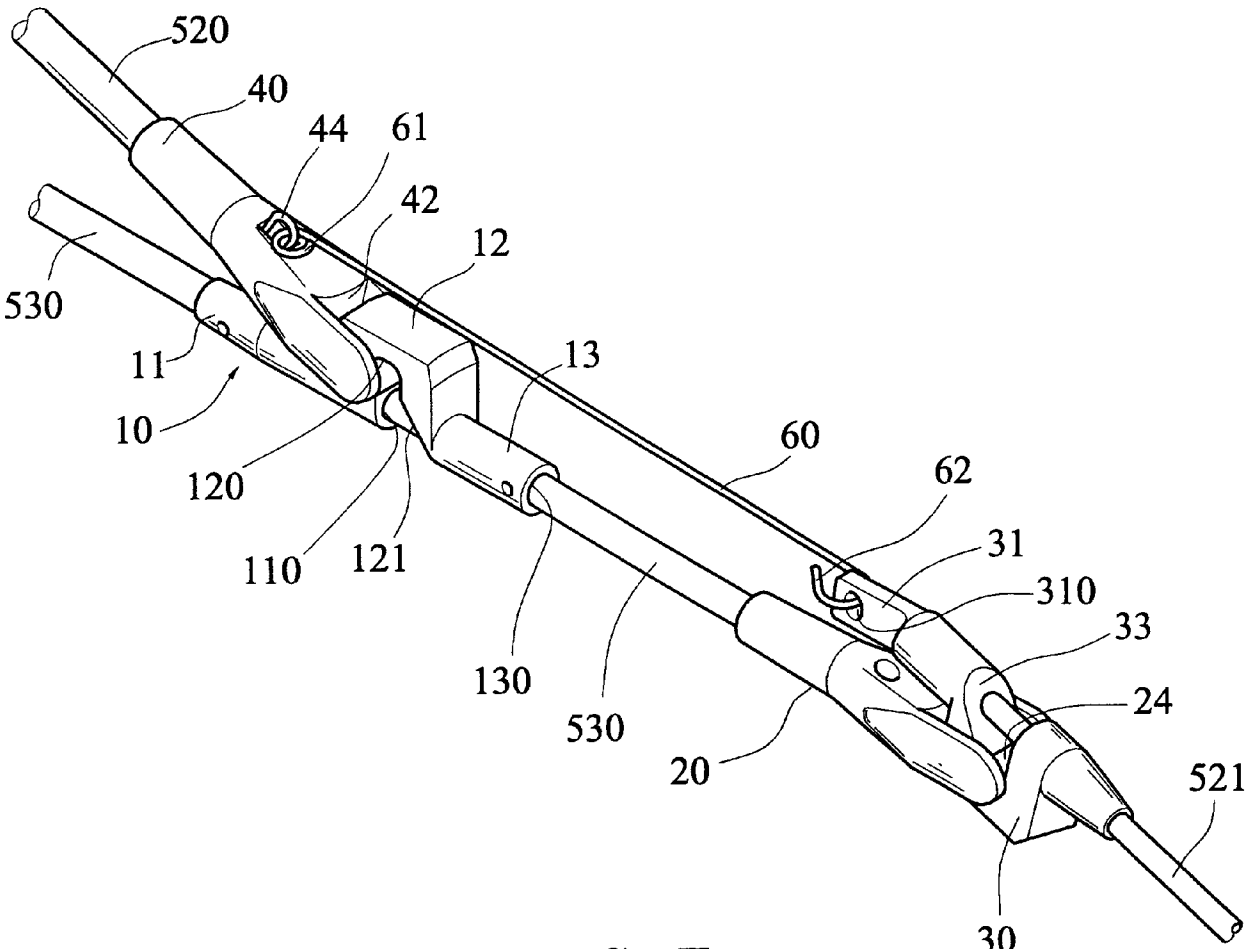
FIG. 7 is a perspective view of a rib connection portion of an FRP umbrella according to a second preferred embodiment of the invention.
Figure 8:
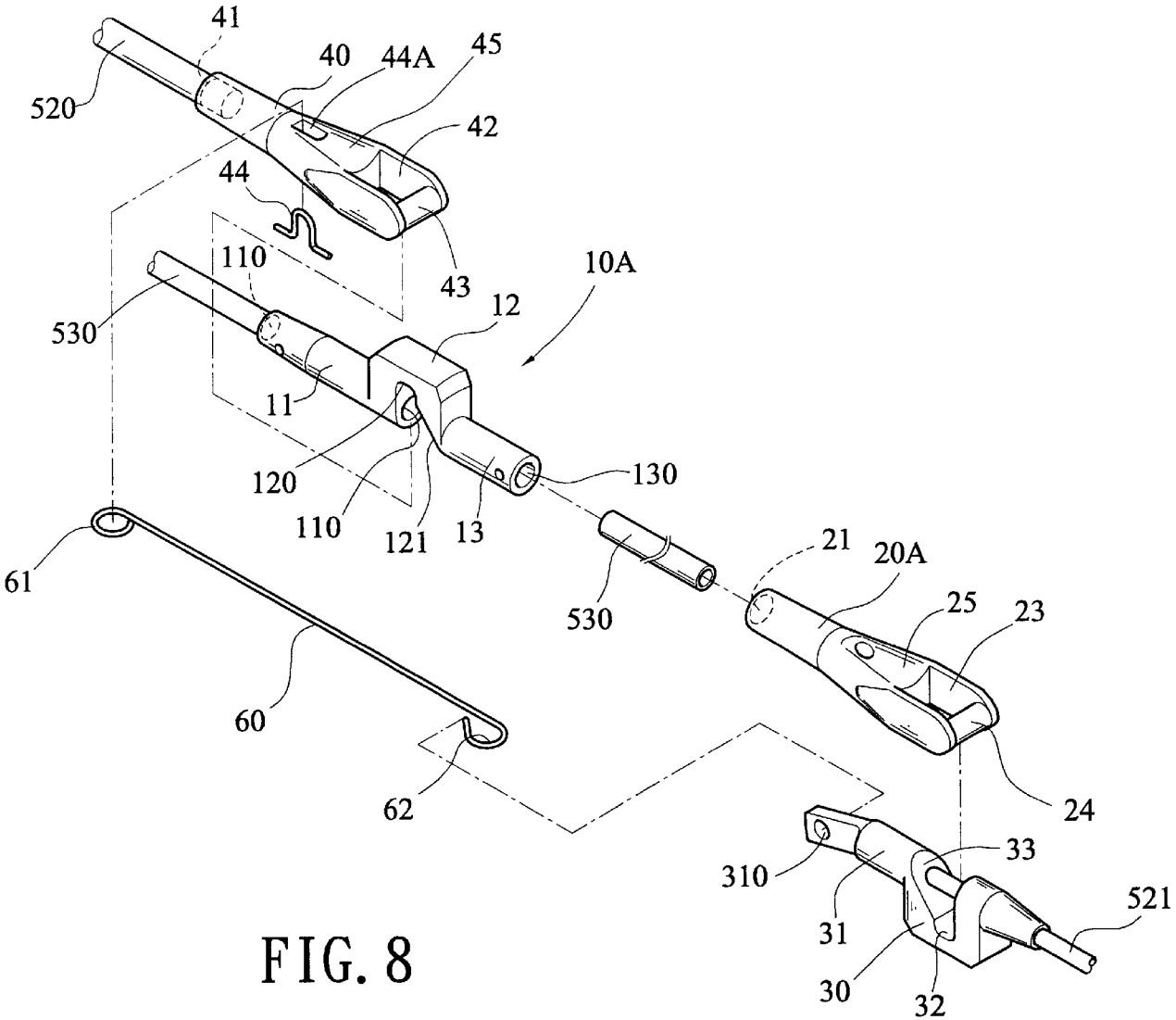
FIG. 8 is an exploded perspective view of FIG. 7.
Figure 9:
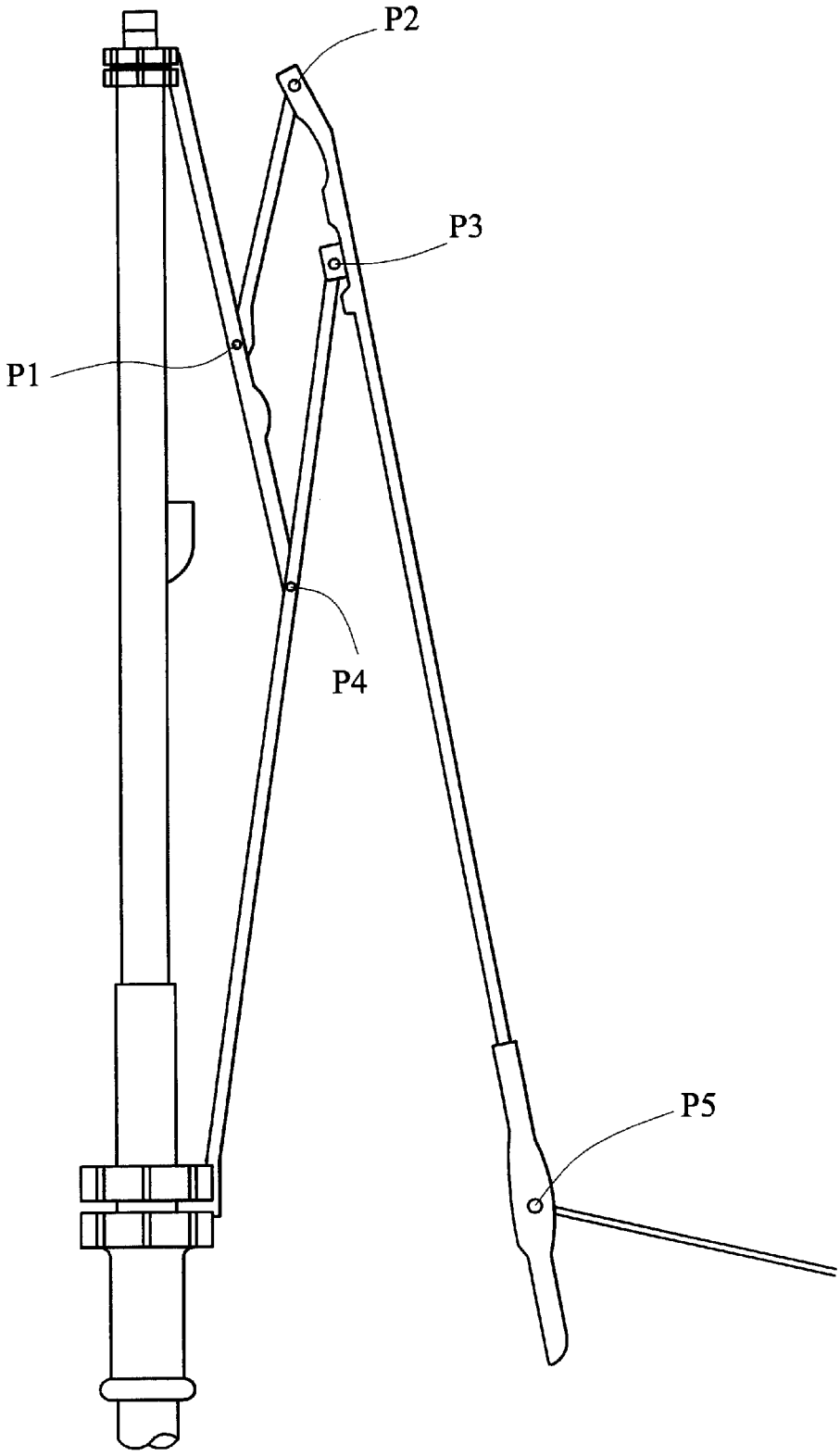
FIG. 9(PRIOR ART)
FIG. 9 is a side elevational view of partial frame of a conventional umbrella having a two-section rib.

Referring to FIGS. 7 and 8, there is shown an FRP umbrella frame according to a second preferred embodiment of the invention. The first and second preferred embodiments are substantially the same except the following as detailed below. In the second preferred embodiment a single spreader is employed. The second pivot mechanism 10 has a single first channel 110 and the first pivot mechanism 30 has a single first bore 21 respectively. Accordingly, widths of the connectors 11, 31 are decreased for being adapted to the second pivot connecting member 40 and the first pivot connecting member 20 respectively. Hence, the second preferred embodiment is suited to smaller umbrella frame.

It is to understood that in order to further reduce the size of the umbrella frame of the present invention after being folded, in the embodiment of the invention there are provided a recess 25 and 45 on the first and second pivot connecting member, respectively and an inner free end of the connector 31 of the first pivot mechanism 30 having a curving portion to enable the first and second pivot connecting member and the first and second pivot mechanism to be folded as closer as possible after folded, as shown in FIGS. 2, 6 and 7.

In brief, the spreaders and the upper and lower ribs are supported by a four-sided structure including of the first and second pivot connecting members, the first and second pivot mechanisms, and the rods being pivotably coupled together.

While the invention herein disclosed has been described by means of specific embodiments, numerous modifications and variations could be made thereto by those skilled in the art without departing from the scope and spirit of the invention set forth in the claims.

What is claimed is:

1. An umbrella having a canopy and a frame, the frame comprising:

a shank including a top hub, an upper ring and a lower ring, both in which upper and lowering are slidably sleeved on the shank;

a plurality of ribs radially extended outwardly from the hub, each rib including an upper rib and a lower ribs;

a plurality of corresponding spreaders, each spreader joined between the respective rib and the upper ring;

a plurality of first pivot connecting member 20, each including a first bore 21, a rectangular first opening 23 at the other end opposite to the first bore, and a cylindrical first cross bar 24 at an outer side of the first opening 23;

a plurality of first pivot mechanism 30, each including a first connector 31 having a bore 311 therein, a first through hole at an open end of the first connector, a U-shaped tunnel 32 on a central portion, and the other end of the first pivot mechanism having a channel 312 for passing through the lower rib, a lower end of the lower rib fixed to the canopy;

a plurality of second pivot mechanism 10 at about middle portions of the spreaders 530, each second pivot mechanism 10 including an elongate first connector 11 having a first channel 110, an inverted U-shaped attachment member 12 having one end coupled to the first connector 11, an extension sleeve 13 coupled to the other end of the attachment member 12, the extension sleeve 13 including a second channel 130 being aligned with the first channel 110;

a plurality of second pivot connecting member 40 each including a second bore 41 at one end for receiving and fixing an outer end of the upper rib 520, a rectangular second opening 42 at the other end thereof, a cylindrical second cross bar 43 at an outer side of the second opening 42, a third opening 44A provided beside an inner side of the second opening 42, and a U-shaped hooking member 44 nested within the third opening 44A; and a plurality of rods each including a first hook end 61 and a second hook end 62;

wherein in assembly, each second cross bar 43 is anchored in the underside tunnel 120 for pivotably coupling the second pivot connecting member to the second pivot mechanism, each spreader 530 is passed through the first and second channels 110, 130 to receive in the first bore 21, each upper rib 520 is inserted into the second bore 41, each first cross bar 24 is passed through the first connector 31 and anchored in the U-shaped tunnel 32 for pivotably coupling the first pivot connecting member to the first pivot mechanism, and each of the lower rib is passed through the channel 312 and inserted into the bore 311, and the first hook ends 61 of each rod 60 is inserted through the U-shaped hook member 44 and the second hook end 62 is inserted through the hole of the first connector 31 respectively for fastening the second pivot connecting member and the first pivot mechanism together.

2. The umbrella of claim 1, wherein each spreader comprises two parallel sub-spreaders, each second pivot mechanism further comprises a third channel, and each second pivot connecting member further comprising a second bore so that one sub-spreader passes through the first and second channels to receive in the first bore and the other sub-spreader passes through the third channel to receive in the second bore.

3. The umbrella of claim 1, further comprising a spring biased between the upper and lower rings and a plurality of corresponding auxiliary stretchers joined between the spreaders and the lower ring whereby an opening of the umbrella will be automatic.

4. The umbrella of claim 1, wherein the first pivot mechanism 30 has a width slightly smaller than that of the first opening of the first pivot connecting member.

5. The umbrella of claim 1, wherein the second opening 42 has a width slightly larger than that of the attachment member.

6. The umbrella of claim 1, wherein the first and second pivot connecting member and the first and second pivot mechanism are made of plastic.

7. The umbrella of claim 1, wherein the rib and the spreader are made of fiber glass reinforced plastics.

8. The umbrella of claim 1, wherein the second pivot mechanism further comprises a second slope extended from an underside tunnel of the attachment member to one end of the extension sleeve.

9. The umbrella of claim 1, wherein the first pivot mechanism is further comprises a first slope at a side of the U-shaped tunnel.

10. The umbrella of claim 1, wherein the first and second pivot connecting member are further comprises a recess on a surface thereof, respectively.

11. The umbrella of claim 1, wherein the first pivot mechanism further comprises a curving portion provided at an inner free end of the connector 31 of the first pivot mechanism 30.

* * * * *